US011135618B2

(12) United States Patent
Malmberg et al.

(10) Patent No.: US 11,135,618 B2
(45) Date of Patent: Oct. 5, 2021

(54) WEAR RESISTANT SCREENING MEDIA

(71) Applicant: SANDVIK INTELLECTUAL PROPERTY AB, Sandviken (SE)

(72) Inventors: Mats Malmberg, Rydsgard (SE); Thomas Fransson, Trellborg (SE); Eskil Beckdahl, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 169 days.

(21) Appl. No.: 16/461,688

(22) PCT Filed: Nov. 17, 2016

(86) PCT No.: PCT/EP2016/078003
§ 371 (c)(1),
(2) Date: May 16, 2019

(87) PCT Pub. No.: WO2018/091095
PCT Pub. Date: May 24, 2018

(65) Prior Publication Data

US 2019/0351454 A1 Nov. 21, 2019

(51) Int. Cl.
*B07B 1/48* (2006.01)
*B07B 1/46* (2006.01)

(52) U.S. Cl.
CPC ..... *B07B 1/4663* (2013.01); *B07B 1/469* (2013.01); *B07B 1/4672* (2013.01); *B07B 1/48* (2013.01)

(58) Field of Classification Search
CPC ..... B07B 1/4663; B07B 1/4672; B07B 1/469; B07B 1/48
USPC ..... 209/233
See application file for complete search history.

(56) References Cited

U.S. PATENT DOCUMENTS 1,561,632 A * 11/1925 Woodward ..... B07B 1/4654 209/397
1,718,385 A 6/1929 Frederic
2,964,187 A * 12/1960 Erich ..... B07B 1/49 209/392

(Continued)

FOREIGN PATENT DOCUMENTS

CA 2524540 A1 5/2006
EP 2796211 A1 10/2014

(Continued)

OTHER PUBLICATIONS

Nadutyi et al. "Polymeric screening of vibration screens". Polymeric screening surfaces vibrator screens reference guide. Moscow, 1993.

(Continued)

*Primary Examiner* — Terrell H Matthews
(74) *Attorney, Agent, or Firm* — Corinne R. Gorski

(57) ABSTRACT

Screening media is arranged to screen oversized material, the media having a main body and a plurality of openings extending through the main body between an upward facing contact face and a downward facing bottom face. A textured pattern is provided at the contact face to provide a roughened surface for the partial entrapment of material fines. Such a configuration protects the screen media from aggressive contact with the material to be screened and provides a bedding layer that is maintained by material-on-material attrition during bulk material flow over the media.

15 Claims, 5 Drawing Sheets

(56) References Cited

U.S. PATENT DOCUMENTS

| | | | | |
|---|---|---|---|---|
| 4,033,865 | A * | 7/1977 | Derrick, Jr. | B07B 1/4663 209/275 |
| 5,330,057 | A | 7/1994 | Schiller et al. | |
| 5,687,853 | A * | 11/1997 | Askew | B07B 1/4681 209/393 |
| 6,152,307 | A * | 11/2000 | Adams | B01D 29/012 209/403 |
| 6,565,698 | B1 * | 5/2003 | Adams | B01D 29/012 156/290 |
| 2003/0042179 | A1 * | 3/2003 | Adams | B07B 1/49 209/408 |
| 2007/0108107 | A1 * | 5/2007 | Morrow | B07B 1/46 209/405 |
| 2012/0273397 | A1 | 11/2012 | Olsen et al. | |
| 2016/0038976 | A1 | 2/2016 | Moon et al. | |

FOREIGN PATENT DOCUMENTS

| | | | |
|---|---|---|---|
| GB | 1154100 | A | 6/1969 |
| RU | 1777970 | A1 | 11/1992 |
| RU | 2175895 | C2 | 11/2001 |
| RU | 2369446 | C1 | 10/2009 |
| RU | 2414971 | C1 | 3/2011 |
| SU | 1276371 | | 12/1986 |

OTHER PUBLICATIONS

Evzovich et al. “Car tires, wheel disks and rims”. Moscow, 2010.

* cited by examiner

WEAR RESISTANT SCREENING MEDIA

RELATED APPLICATION DATA

This application is a § 371 National Stage Application of PCT International Application No. PCT/EP2016/078003 filed Nov. 17, 2016.

FIELD OF INVENTION

The present invention relates to screening media to screen material having a size distribution and in particular, although not exclusively, to screening media having a textured pattern provided at an upward facing contact face to reduce frictional wear of the media.

BACKGROUND ART

Screening apparatus such as vibrating screen decks, rotating or stationary screens are used for a variety of applications and may comprise interchangeable square or rectangular screen elements that provide a screen surface upon which bulk material having a non-uniform size (size distribution) may be deposited and size graded. Alternatively, the screen (commonly referred to as the screening media) may be of a cross-tensioned, length-tensioned or pre-tensioned media type having a sheet-like structure that extends between lengthwise extending deck sides. In particular, the tensioned screening media may be formed from wire mesh, metal sheet or reinforced polyurethane/rubber. Wire mesh media is advantageous as it is easy to mount, relatively low cost and includes a large open structure to facilitate screening a greater range of stone or gravel fractions.

Cross-tensioned and length-tensioned screening media is mounted in the vibrating screen using hooks or fastenings attached to the side or end walls of the screen deck whilst pre-tensioned media is typically pressed downwardly onto a lower support frame by abutment brackets also mounted at the side walls. The screen media is supported from below by support beams spaced apart and arranged parallel to the sidewalls. The support beams are typically arranged at different heights in order to support media between the sidewalls in a crowned profile or at an inclined angle when secured in position.

Screen decks may also comprise modular screen elements in which the screening media comprises interchangeable panels that are tessellated together between the deck walls. An example screen material (or screen cloth) is described in US 2016/0038976 in which a generally rigid metal plate includes a plurality of openings extending through the cloth body. The metal plate is covered by an elastomer coating or liner at the impact surface with a wear resistance material at least partially embedded in the elastomer. Further examples of screening material are described in CA 2524540; US 2012/0273397; and GB 1,154,100.

U.S. Pat. No. 5,330,057 discloses a multi-layer composite screen cloth in which a wire mesh, that represents the uppermost contact face, is formed from elongate wire elements manufactured with random longitudinal score marks so as to provide a general roughness to the contact face that is intended to improve conveyance and reduce the likelihood of blinding by the bulk material. However, such screening media has limited application to screen relatively fine grade materials. Additionally, such media is disadvantageous due to its complex manufacturing and construction. Accordingly, what is required is a wear resistant screening media suitable for screening a broad range of material types (of different particulate grade) that addresses the above problems.

SUMMARY OF THE INVENTION

It is an objective of the present invention to provide screening media that is resistant to wear by the continual abrasive contact with a material flow over the media. It is a further objective to provide a screening media that is convenient to manufacture, and install and interchange at screening apparatus (i.e., screen decks). It is a further specific objective to provide a screening media configured to be self-protecting from abrasive wear without the need for one or a plurality of abrasion resistant layers typically formed from a high hardness material such as a metallic mesh or the like. Accordingly, it is a further specific objective to provide a screening media of reduced weight so as to facilitate transportation, and installation and removal at a screen deck whilst being structurally robust so as to withstand the abrasive contact with the bulk material.

The objectives are achieved by providing a screening media having a specifically configured contact face adapted to be self-protecting in use. In particular, the present screening media comprises a textured pattern at an upward facing contact surface configured to at least partially entrap 'fines' or smaller particulates of the material to be screened so at to build a protective bed or layer over the contact face. Advantageously, the textured contact face is adapted to be responsive to the magnitude of the abrasive contact with the material to be screened in that as the volume of material flowing over the bed increases, the protective material bed is continuously replenished, rebuilt and enhanced by the material flow.

According to a first aspect of the present invention there is provided screening media to screen material, the media comprising: a main body having a contact face intended to be upward facing to contact material to be screened and a bottom face intended to be downward facing, the main body having a thickness defined between the contact and bottom faces; a plurality of openings extending through the thickness of the main body between contact and bottom faces; characterised by: a repeating textured pattern provided at the contact face.

Reference within this specification to a 'repeating textured pattern' encompass a profiled surface having regions of different height including raised and recessed parts. This term encompasses texturing provided at a surface by any one or a combination of ridges, ribs, lumps, projections, protuberances, grooves, cavities, pimples or channels. This term also encompasses the pattern being a regular repeating pattern and not a random collection of raised or recessed regions so as to be generally consistent and uniform over the contact face.

Optionally, the main body comprises a single piece material. Optionally, the main body may comprise at least a first layer and a second layer bonded or attached together to form a composite structure, the first layer defining the contact face and the second layer defining the bottom face. The main body comprising a multi-layer structure is advantageous to facilitate manufacturing. In particular, the multiple layers may be formed from different materials or material compositions that may be bonded or attached together by thermal bonding or mechanical attachment means such as pins, screws, rivets, bolts of the like. Where one of the material layers comprises a rubber or polymer material, the layers may be bonded by heat treating, heat pressing or vulcanisation.

Preferably, the first layer comprises a first material and the second layer comprises a second material, a hardness of the first material being less than a hardness of the second material. Such a configuration is advantageous to facilitate manufacturing in that the textured pattern at the contact face may be formed conveniently by a 'branding' process at the contact surface involving heating the main body and pressing a mesh (or other suitable substrate) into the first layer so as to imprint a roughened profile formed from peaks and valleys (troughs) according to the shape profile of the mesh (or substrate) as it is removed from the first layer. Optionally, this process may involve heating the main body and/or the mesh or substrate. The first layer may then be bonded to the second layer by a further heat pressing stage. Optionally, the first material of the first layer may be formed from a polymeric material including rubber, polyurethane and the like. Optionally, the second material of the second layer may comprise a polyester, a polyamide, nylon, carbon fibre and the like. Where the first material of the first layer is a rubber, the first and second layers may be bonded by vulcanisation. Preferably, the branding process, as described, may form part of the vulcanisation process for a composite (multi-layer) structure (i.e., bonding of multiple layers) to avoid additional heating and pressing stages. Optionally, the first layer and the second layer may be attached together by thermal or chemical bonding (e.g., via an adhesive) or mechanical attachment such as by pins, bolts, rivets, screws and the like.

Preferably, the pattern is represented by peaks and troughs at the contact face, a depth of the pattern being defined as the separation distance between the peaks and troughs in a plane extending parallel to the thickness of the media. Optionally, the depth of the pattern is in a range 0.05 mm to 10 mm. Optionally, the pattern depth range is 0.1 mm to 8 mm or 0.2 mm to 5 mm. Such a configuration provides the desired pocket or cavity size at the textured contact face to build the protective bed of material that covers the screening media and accordingly facilitates material-on-material abrasive contact. Such a configuration is further beneficial to continuously rebuild the protective layer as fines or small particulates (that are capable of being entrapped between the peak and troughs) are created by the abrasive material-on-material attrition as the bulk material flows over the protective bed. Such an effect ensures the screening media is continually protected and the desired wear resistance provided.

Preferably, a thickness of the first layer is greater than a thickness of the second layer. Optionally, a thickness of the second (reinforcement) layer is 5 to 50% of the first layer. Optionally, the thickness of the media between an uppermost part of the contact face and the bottom face is in the range 1 mm to 20 mm, 1 mm to 10 mm, 2 mm to 4 mm, 4 mm to 6 mm or 6 mm to 8 mm. Optionally, where the screening media comprises an upper first layer and lower second layer, the second layer (being of a higher hardness than the first layer) may comprise a thickness in the range 0.4 mm to 1.0 mm; 1.0 mm to 2.0 mm or 1.5 mm to 2.5 mm. Such configurations may comprise a single second layer, a dual second layer or three second layers respectively. The multiple second layers may be attached together by thermal or chemical bonding (e.g., via an adhesive) or mechanical attachment such as by pins, bolts, rivets, screws and the like.

Optionally, a width, length or diameter of each of the openings in a plane perpendicular to the thickness of the media is in a range 1 mm to 50 mm. The openings may comprise any shape profile including a polygonal shape profile, a square, rectangular, circular, or oval shape profile. Preferably, a cross sectional area of the openings in a plane perpendicular to the thickness of the media is generally uniform or increases through the thickness of the main body between the contact and bottom faces. Accordingly, the size of the openings may be generally uniform or may decrease through the thickness of the media such that a cross sectional area of the openings at the contact face may be approximately equal or may be less than the cross sectional area of the openings at the bottom face. Such a configuration is advantageous to allow the unhindered passage of material of the desired particulate size through the media and reduce the likelihood of blinding (blockage) of the openings. In particular, where the screening media is formed as a multi-layer composite, the size of the openings are uniform or increase through the thickness of the media and in particular through each of the layers.

Preferably, at least first regions of the contact face are generally planar, said first regions representing peaks of the pattern that are raised relative to second regions representing troughs of the pattern. The generally flat contact surface into which the textured pattern is formed, is advantageous to provide a generally planar surface for the contact of the material flow. This provides generally uniform wear across the entire contact surface and facilitates the generally uniform building of the protective bed having a generally uniform thickness in a plane perpendicular to the material flow (corresponding to a thickness of the screening media). The peaks of the textured pattern may be formed by relatively sharp crests and the valleys (or troughs) may be formed by generally smooth, curved or rounded valleys extending between the crests. Optionally, the textured pattern is formed by imprinting a mesh or other substrate into the contact surface with the mesh being formed from a weave (e.g., a metal mesh) in which the warps and wefts comprise a generally circular cross sectional profile. Optionally, the warps and wefts may comprise a square or rectangular cross sectional profile so as to form corresponding square or rectangular shaped valleys and peaks. Preferably, the pattern extends over all or a majority of the contact face. Preferably, the regular repeating pattern extends over the entire contact face and in between the openings.

Optionally, a depth of the pattern represented by a separation distance between peaks and troughs of the pattern at the contact face is in a range 5% to 70% of a total thickness of the media between the bottom face and the peaks of the contact face.

According to a second aspect of the present invention there is provided screening apparatus to screen bulk material, the apparatus comprising: a plurality of support beams; at least a pair of sidewalls; and the screening media as claimed herein mounted upon the support beams and extending between the sidewalls.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
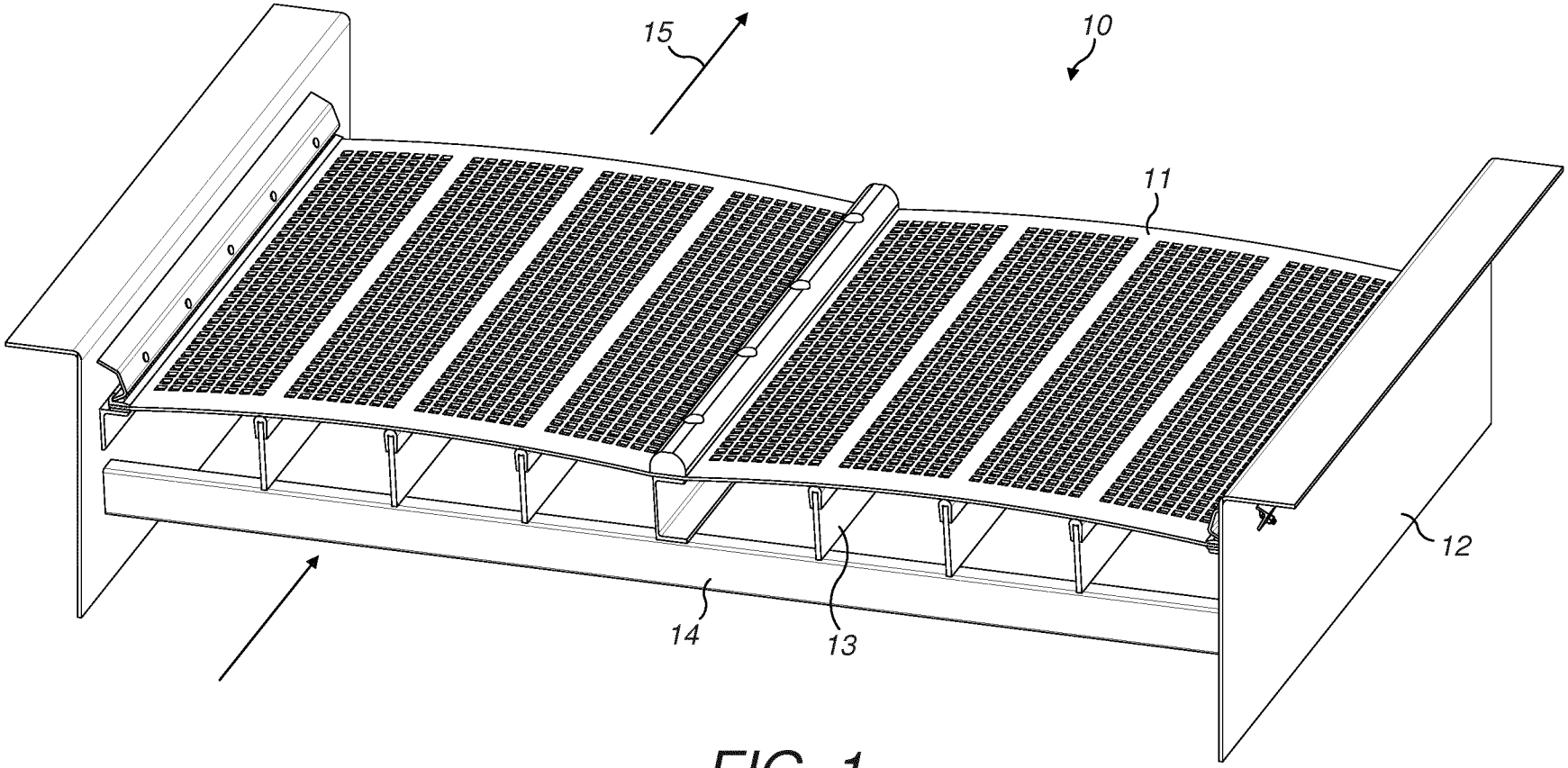
FIG. 1 is a perspective view of part of a screen deck having lengthwise and widthwise extending support beams to seat screening media between respective sidewalls according to a specific implementation of the present invention.

FIG. 1 illustrates a part of a screening apparatus (or screen deck) 10 in which a mat-like screen media 11 is pre-tensioned to extend lengthwise and widthwise between a pair of respective sidewalls 12. Media 11 is supported at its underside by a plurality of lengthwise extending beams 13 that are in turn mounted on a lower support frame 14 formed from one or a plurality of cross beams extending between sidewalls 12. Media 11 may be pre-tensioned in the widthwise direction between sidewalls 12 and/or in the lengthwise direction between a first end and a second end (not shown) where the length of the media 11 corresponds to a flow direction of the material to be screened indicated generally by arrow 15.

Figure 2:
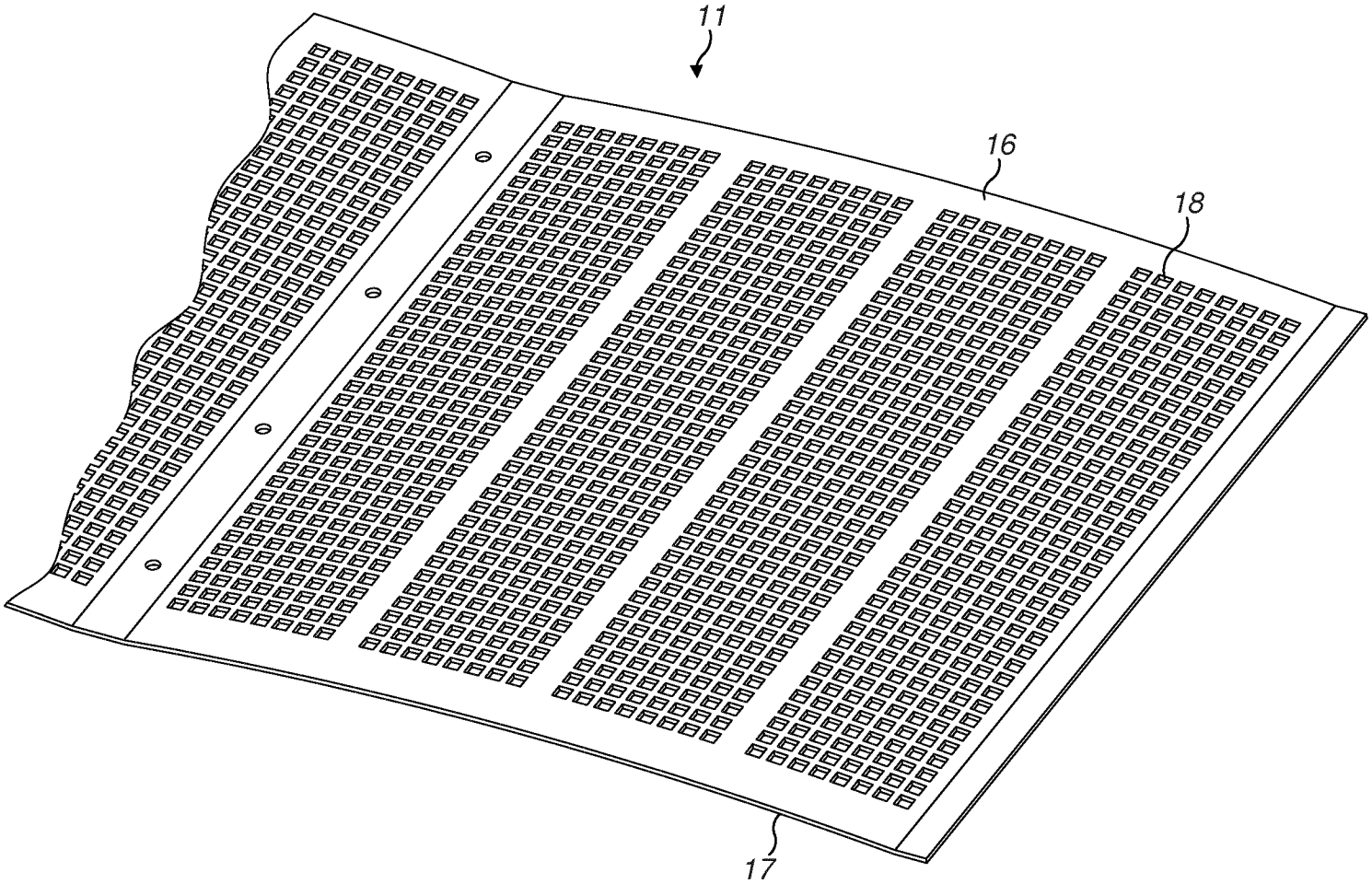
FIG. 2 is a perspective view of the screening media forming part of the screen deck of FIG. 1.
Figure 3:
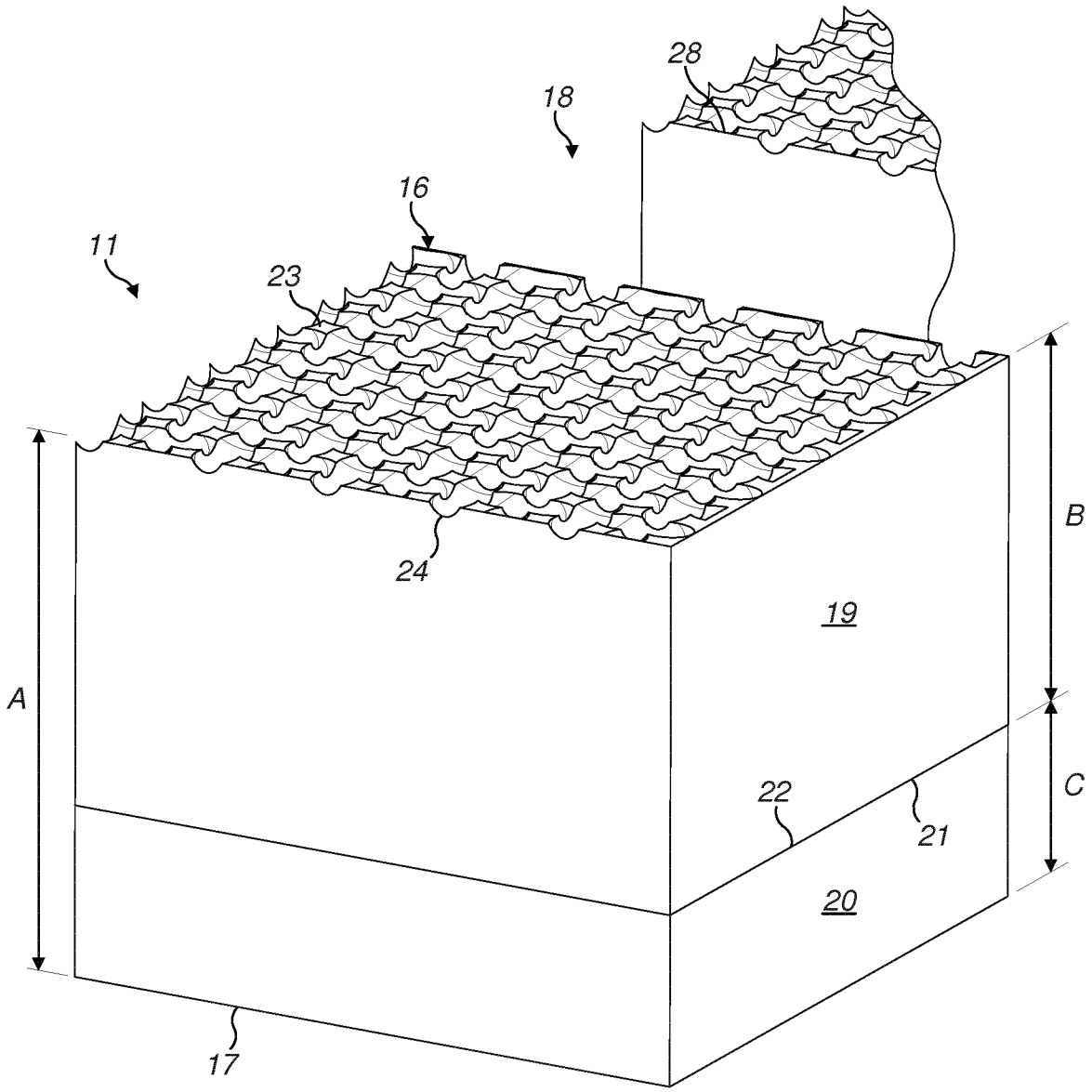
FIG. 3 is a magnified section view through part of the screening media of FIG. 2.

Referring to FIGS. 2 and 3, media 11 comprises a generally planar overall shape profile having a generally planar contact face 16 and a generally planar opposed downward facing bottom face 17. In use, contact face 16 is intended for contact with the material flow 15 whilst bottom face 17 is intended for contact with the support beams 13 either directly or indirectly via intermediate mounting shoes or attachment braces. Both the contact and bottom faces 16, 17 are generally planar. However a textured pattern is provided at contact face 16 that accordingly comprises a surface roughness relative to bottom face 17 that may be considered to be relatively smooth or non-profiled in comparison. A plurality of openings 18 extend completely through a thickness of media 11 so as to extend between the contact and bottom faces 16, 17. Accordingly, and in use, as the bulk material to be screened flows in a lengthwise direction along media 11 (between sidewalls 12), appropriately sized (relatively smaller) particles or pieces fall through openings 18 whilst oversized pieces are retained at contact face 16.

Figure 4:
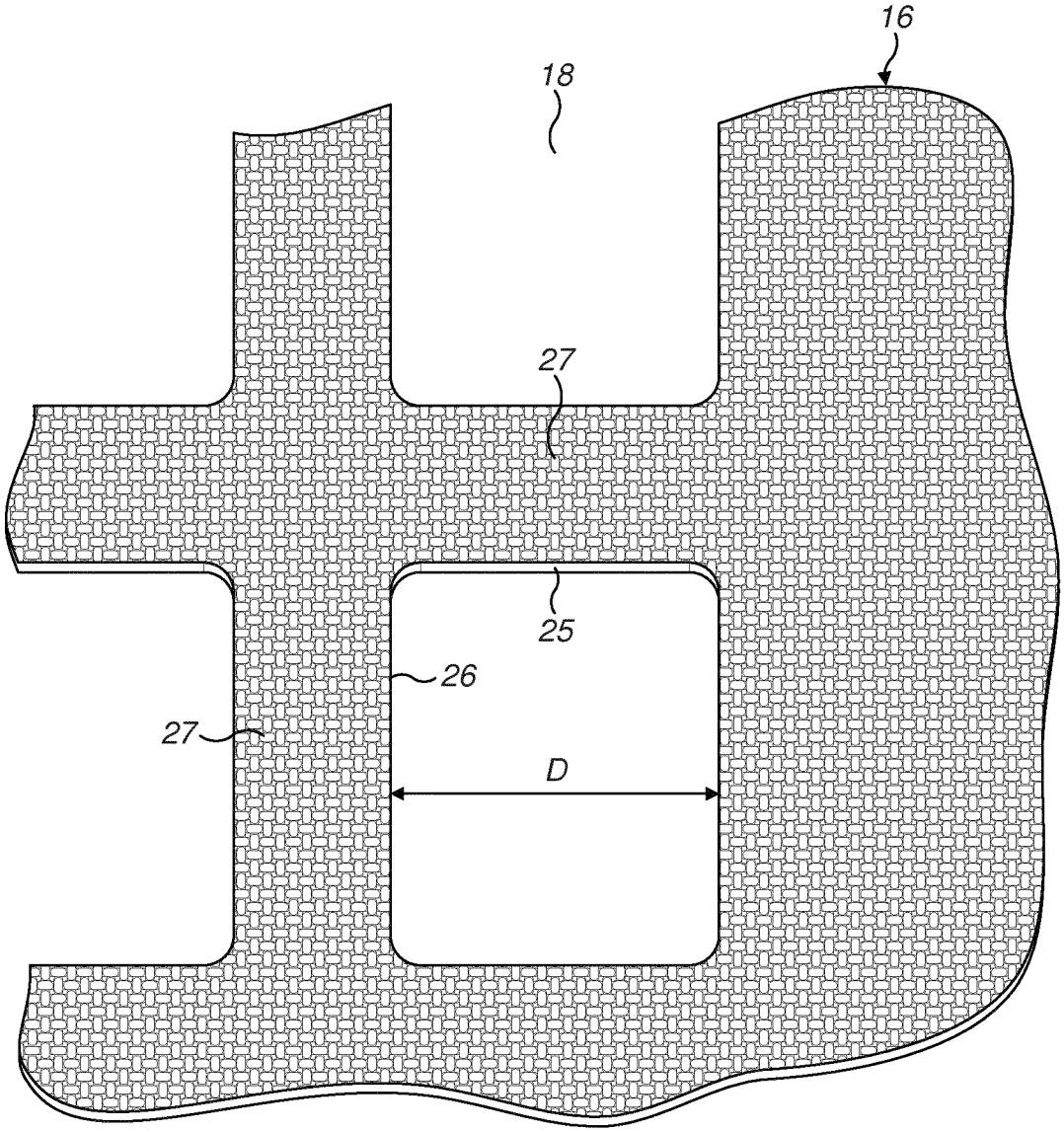
FIG. 4 is a perspective magnified view of a part of the screening media of FIG. 2.

Referring to FIGS. 3 to 6, screen media 11 according to the specific implementation is formed as a two-piece composite having an uppermost first layer 19 and a lowermost second layer 20. First layer 19 is formed from a rubber material whilst second layer 20 is formed from a polyester material having a hardness greater than that of first layer 19. First layer 19 comprises an opposed downward facing surface 21 that is bonded to an upward facing surface 22 of second layer 20. According to the specific implementation, bonding between surfaces 21 and 22 is achieved by vulcanisation of first layer 19 on second layer 20. A thickness B in a plane perpendicular to the contact and bottom faces 16, 17 of the first layer 19 is greater than a corresponding thickness C of the second layer 20 such that a total thickness A of the media 11 (represented by layers 19 and 20) is defined between contact face 16 and bottom face 17. According to one specific implementation, a thickness of first layer 19 is in a range 1 mm to 6 mm and the thickness C of second layer 20 is in a range 0.4 mm to 1.0 mm. According to further specific implementations, screen media 11 may comprise a plurality of second layers 20 attached or bonded together to form a composite second layer 20. The function of second layer 20 is to provide rigidity and support to the relatively softer first layer 19. Accordingly, enhanced stiffness and strength may be achieved by increasing the number of second layers 20 with the affect that the total thickness A of the screen media 11 is increased. According to one specific implementation, a thickness A of the screen media 11 may be in a range 2 mm to 4 mm, 4 mm to 6 mm or 6 mm to 8 mm where the second (reinforcement) layer 20 comprises a thickness C of 0.5 mm to 1.0 mm; 1.0 mm to 2.0 mm or 1.5 mm to 2.5 mm. As will be appreciated, the size of the openings 18 within the media 11 may vary depending upon the size or grade of the media 11. According to the specific implementation, openings 18 comprise a generally rectangular cross sectional profile (in the plane of the contact face 16) and comprise a width D and a corresponding length in a range 1 mm to 50 mm, typically 10 mm to 20 mm. Accordingly, the contact face 16 is defined in part by what may be regarded as cross beams 27 that extend between and at least partially define the openings 18. A relative width of the cross beams 27 (in a plane of contact face 16) is in a range 30% to 60% of the width (diameter or length) D of the openings 18. The cross sectional shape profile of the openings 18 is uniform through the thickness of a media 11 between the contact face 16 and the bottom face 17. That is, the width (length or diameter) D of the openings 18 is the same and uniform at the contact face 16 and at the bottom face 17. As illustrated in FIG. 4, openings 18 are defined by sidewalls 25 and 26 that also define, in part, cross beams 27. Accordingly, the contact face 16 and the bottom face 17 at the cross beams 27 are defined between respective exit ends 28 of openings 18 extending through media 11, with the exit ends 28 provided at both the contact and bottom face 16, 17. According to further embodiments, the width (length or diameter) D of the openings 18 increases through the media 11 in a direction from the contact face 16 to the bottom face 17 such that a corresponding cross sectional area of the openings 18 increases from the contact face 16 to the bottom face 17. Such an arrangement may be beneficial to reduce the likelihood of blinding of the openings 18 by the flow of material.

Figure 5:
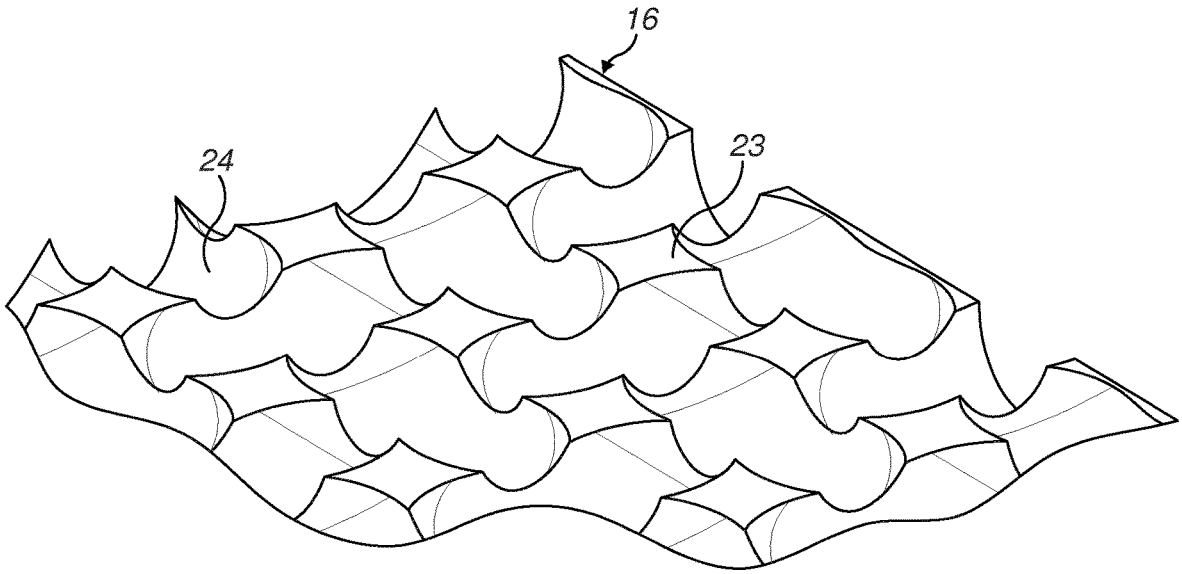
FIG. 5 is a further magnified view of a region of the contact face of the screening media of FIG. 2 having a textured pattern formed by peaks and troughs according to a specific implementation of the present invention.
Figure 6:
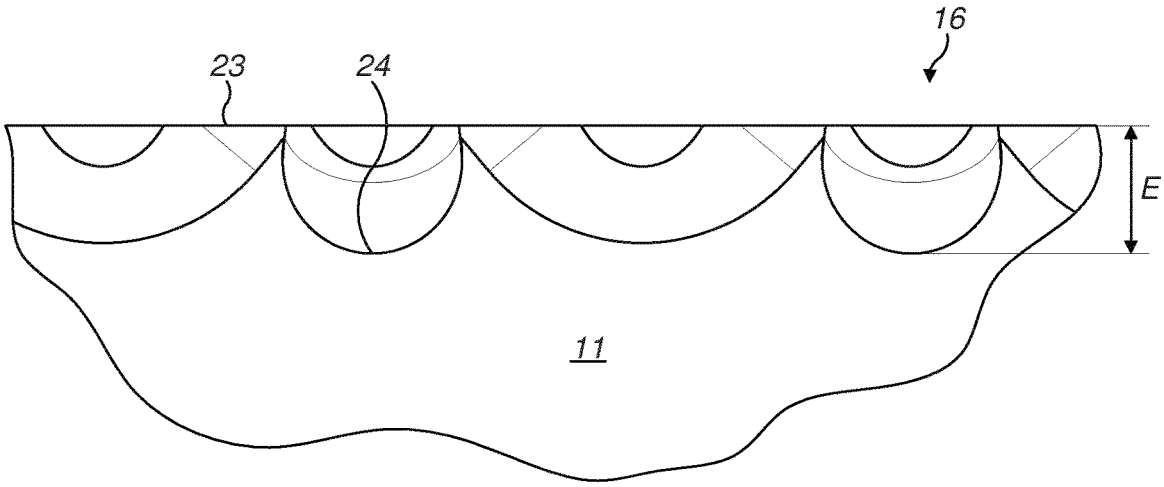
FIG. 6 is a side elevation end view of the textured pattern at the contact face of FIG. 5.

According to the specific implementation, the textured pattern provided at contact face 16 extends over the entire contact face 16 including the cross beams 27 defined between the exit ends 28 of the openings 18. The textured pattern is formed from peaks 23 and respective troughs 24 that collectively define a repeating pattern at contact face 16. Referring to FIGS. 5 and 6, the textured pattern may be created conveniently by pressing a woven mesh (or other substrate) into the first layer 19 (when formed from a rubber material) as part of the vulcanisation process. Once the mesh is removed, an imprinted pattern is formed corresponding to the shape profile of the woven mesh so as to define the peaks 23 and troughs 24. As will be appreciated, the shape of the textured pattern at the contact face 16 may be achieved by selecting the appropriate dimensions and cross sectional shape profile of the warps and wefts of the imprinting mesh. According to the specific implementation, the textured pattern at contact face 16 is formed by troughs 24 that are continuously curved which are in turn formed by the wefts and warps having a generally circular cross sectional profile.

As illustrated in FIGS. 3 and 6, a relative depth E of the textured pattern at the contact face 16 (defined as the separation distance between the peaks 23 and troughs 24 in a plane perpendicular to the plane of the media 11) is much less than the total thickness A of the media 11 and the thickness B of the first layer 19. In particular, the distance E may be in a range 0.5 mm to 5 mm depending upon the thickness B of the first layer 19. Such a configuration provides a surface roughness at contact face 16 whilst ensuring first layer 19 comprises a sufficient thickness to achieve the desired structural strength of the media 11 capable of being pre-tensioned between sidewalls 12. In particular, depth E may extend in a range 5% to 50% of thickness B of first layer 19.

In use, as material to be screened flows across the media 11 in direction 15, relatively small particulates of the material are deposited and at least partially entrapped by the textured pattern defined by peaks and troughs 23, 24. The material particles or fines accumulate at the textured pattern so as to build a protective bed or layer of material coating and protecting the contact face 16. Accordingly, frictional contact resultant from the conveyed material is not translated directly to first layer 19 but instead involves material-on-material contact between the primary flow of material and the built material bed. Providing a generally uniform textured pattern a contact face 16 (i.e., formed by peaks and troughs 23, 24 of generally the same height and depth over the entire contact surface 16) ensures a generally uniform wear protection for the media 11 and in particular first layer 19. As will be appreciated, a depth of the protective bed may be varied according to variation of distance E corresponding to a depth of the textured pattern between peaks and troughs 23, 24.

The invention claimed is:

1. A screening media arranged to screen material, the media comprising:

a main body having a contact face arranged to be upward facing to contact material to be screened and a bottom face arranged to be downward facing, the main body having a thickness defined between the contact and bottom faces;

a plurality of openings extending through the thickness of the main body between the contact and bottom faces; and a repeating textured pattern provided along the entire contact face in between the plurality of openings, wherein the pattern is formed by peaks and troughs at the contact face to form a plurality of cavities or pockets, a depth of the cavities or pockets of the pattern being defined as a separation distance between the peaks and troughs in a plane extending parallel to the thickness of the media, the peaks of the textured pattern being formed by crests and the valleys and the troughs being formed by generally smooth, curved or rounded valleys extending between the crests and square or rectangular shaped peaks.

2. The media as claimed in claim 1, wherein the main body is a single piece of material.

3. The media as claimed in claim 1, wherein the main body includes at least a first layer and a second layer, the first and second layers being bonded or attached together to form a composite structure, the first layer defining the contact face and the second layer defining the bottom face.

4. The media as claimed in claim 3, wherein the first layer includes a first material and the second layer includes a second material, a hardness of the first material being less than a hardness of the second material.

5. The media as claimed in claim 3, wherein a thickness of the first layer is greater than a thickness of the second layer.

6. The media as claimed in claim 1, wherein the depth of the pattern is in a range of 0.05 mm to 10 mm.

7. The media as claimed in claim 6, wherein the range of the depth is 0.1 mm to 8 mm.

8. The media as claimed in claim 1, wherein the thickness of the media between an uppermost part of the contact face and the bottom face is in the range of 1 mm to 20 mm.

9. The media as claimed in claim 8, wherein the range is 1 mm to 10 mm.

10. The media as claimed in claim 1, wherein a width, length or diameter of each of the openings in a plane perpendicular to the thickness of the media is in a range 1 mm to 50 mm.

11. The media as claimed in claim 1, wherein a cross-sectional area of the openings in a plane perpendicular to the thickness of the media is generally uniform or increases through the thickness of the main body between the contact and bottom faces.

12. The media as claimed in claim 1, wherein at least first regions of the contact face are generally planar, said first regions representing peaks of the pattern that are raised relative to second regions representing troughs of the pattern.

13. The media as claimed in claim 1, wherein the pattern extends over all or a majority of the contact face.

14. The media as claimed in claim 1, wherein a depth of the pattern represented by a separation distance between peaks and troughs of the pattern at the contact face is in a range of 5% to 70% of a total thickness of the media between the bottom face and the peaks of the contact face.

15. A screening apparatus arranged to screen bulk material, the apparatus comprising:

a plurality of support beams;

at least a pair of sidewalls; and the screening media as claimed in claim 1 mounted upon the support beams and extending between the sidewalls.

* * * * *